US006733405B2

(12) United States Patent
Gormley

(10) Patent No.: US 6,733,405 B2
(45) Date of Patent: May 11, 2004

(54) BALL

(76) Inventor: Ian Gavin Gormley, 122 Lambert Rd., Morningside 4001 (ZA)

( * ) Notice: Subject to any disclaimer, the term of this patent is extended or adjusted under 35 U.S.C. 154(b) by 0 days.

(21) Appl. No.: 10/294,540

(22) Filed: Nov. 14, 2002

(65) Prior Publication Data

US 2003/0092516 A1 May 15, 2003

(30) Foreign Application Priority Data

Nov. 15, 2001 (ZA) ..... 2001/9435

(51) Int. Cl.[7] ..... A63B 43/00
(52) U.S. Cl. ..... 473/575
(58) Field of Search ..... 473/575, 576, 473/424, 425, 431

(56) References Cited

U.S. PATENT DOCUMENTS 4,088,319 A * 5/1978 Clarke ..... 473/575
4,266,781 A 5/1981 Blue
4,294,447 A * 10/1981 Clark ..... 473/575
4,826,179 A * 5/1989 Callaghan ..... 473/575
5,398,928 A * 3/1995 Rudell et al. ..... 473/575
5,577,732 A * 11/1996 Spector ..... 473/576
5,615,879 A * 4/1997 Bailey ..... 473/424
5,813,931 A * 9/1998 Gormley ..... 473/575

FOREIGN PATENT DOCUMENTS

DE 597 176 5/1934
EP 0 819 451 A1 1/1998

* cited by examiner

*Primary Examiner*—Steven Wong
(74) *Attorney, Agent, or Firm*—Dinsmore & Shohl LLP

(57) ABSTRACT

This invention relates to a streamer ball for use in a ball and bat-type game. The ball is either one of a tennis-type ball and a solid foam-type ball and has one end of an elongate spacer stem connected thereto. The other end of the spacer stem has a plurality of elongate streamers attached thereto. The physical characteristics associated with the ball, the stem and the streamers permit play of a tennis-type game, which involves the ball bouncing, and a volley-type game, that is played without the ball bouncing.

12 Claims, 2 Drawing Sheets

BALL

BACKGROUND

THIS INVENTION relates to a ball.

The invention relates in particular to a ball having a tail, in the form of at least one streamer, extending therefrom, for use in a game in which the ball is struck with a bat, a racquet, a paddle, or the like, hereinafter merely being referred to as a bat. Such a ball is referred to hereinafter as a streamer ball. Typical games with which the ball of the invention is intended to be used include tennis-type games, which allow a ball to bounce before being struck, and badminton and other volley-type games, which require the ball used to be struck without bouncing. Typical balls currently used for the above games include tennis-type balls and foam-type balls, their characteristics being determined by their bounce requirements and the distances they are to travel, during play of a typical game. The games herein envisaged shall hereinafter merely be referred to as ball and bat-type games.

The Applicant herein has proposed, in respect of playing of tennis-type games, the use of a ball having a tail directly attached thereto and extending therefrom. The Applicant's U.S. Pat. No. 5,813,931 (assigned to European Sports Merchandising BV) discloses in particular a series of parameters for such a ball and for the tail of the ball, that provide for desired bounce and flight qualities that enable a tennis-type game to be played with such a ball.

The main benefits of using a ball with a tail attached thereto when playing a tennis-type game include that the ball is slowed down while a regular flight path is provided for. By slowing down the ball when struck with a bat, the distance that the ball can travel is effectively reduced, permitting a tennis-type game to be played in a relatively small area while the ball can still be struck at "full strength". The visual and audible effects that can be created by a tail also can render playing of games using a ball with a tail more pleasing.

A disadvantage associated with the use of a ball having a tail formed of a plurality of streamers, as envisaged within the disclosure of the above United States patent, is that the tail, during play, becomes tangled with the ball. When so tangled, the streamers forming the tail often are struck directly with a bat when the ball is struck, resulting in the tail being destroyed relatively quickly.

It is thus an object of this invention to provide a ball that has a tail, but in respect of which the above disadvantage is at least ameliorated. It is a further object of this invention to provide such a ball that is also suitable for use in badminton and other volley-type games.

Within this specification, in relation to the definition of certain components of the invention, reference is made to a flexibility rating that identifies the actual and relative flexibility of these components. The procedure whereby this rating is established, as outlined in the Applicant's U.S. Pat. No. 5,813,931, constitutes a comparative procedure with the flexibility rating of a component being the distance in millimeters whereby the component can be horizontally displaced beyond the edge of a horizontal support surface before the projecting segment of the component has bent downwards, under the force of gravity, to the extent that the leading end of the component subtends at an angle of 45° to the plane of the horizontal support surface. By way of explanation, therefore, a very flexible component can only be displaced a relatively short distance beyond the edge of a support surface before its leading end subtends at the angle of 45° to the plane of the support surface, thus having a low flexibility rating, whereas a more rigid component can be displaced a longer distance beyond said edge, thus having a higher flexibility rating. The above procedure for establishing a flexibility rating is illustrated with reference to FIGS. 5 and 6 of Applicant's U.S. Pat. No. 5,813,931 and clearly allows for an accurate, measurable and simple comparative test whereby the flexibility of components can be compared and rated, without attempting to define the flexibility of a component on an absolute scale.

Reference is also made herein to the air penetration factor of a ball, this factor as herein envisaged being the ratio of the mass of the ball in grams to the frontal area of the ball in square centimeters.

SUMMARY OF THE INVENTION

According to the invention there is provided a streamer ball for use in a ball and bat-type game, which comprises a ball having a diameter between 20 mm and 100 mm, a mass between 2 g and 75 g, a relative density no greater than approximately 0.75 and an air penetration factor no greater than 1; a tail comprising at least one thin, flexible streamer that has a flexibility rating between 20 mm and 100 mm, a length not less than approximately two times the diameter of the ball and a thickness less than 0.2 mm; and a resiliently flexible, elongate spacer stem having the tail attached thereto near one end thereof and having its other end connected to the ball, the spacer stem separating the attachment point of the tail from the ball by at least 25 mm and having a flexibility rating between 150 mm and 800 mm and a mass, between the tail and the ball, less than 3 g.

The ball of the streamer ball of the invention typically is either one of a hollow tennis-type ball and a solid foam-type ball.

The tail of the streamer ball of the invention may comprise a plurality of streamers, each streamer comprising an elongate flat flexible element of a synthetic plastics material having a thickness less than 0.06 mm. The maximum length of the streamers preferably is in the order of 1000 mm.

The spacer stem of the streamer ball of the invention may comprise an elongate synthetic plastics element having an anchor formation defined at one end thereof which is formed to provide for connection of the spacer stem to the ball. The anchor formation of the spacer stem maybe formed to provide for connection to a hollow tennis-type ball and, as such, the stem, when connected to the ball, may pass through an aperture through the wall of the ball. For the above configuration spacer stem, the stem may provide a snug fit within the aperture in the wall of the ball which inhibits the rate of release of air from the ball, for retaining the bounce qualities of the ball.

The spacer stem typically has a flexibility rating between 300 mm and 400 mm. It is envisaged also that the spacer stem may have a flexibility rating that varies along the length thereof. Still further, it is envisaged that the spacer stem may have a tubular element located over a segment thereof that renders the stem less flexible in the region of the said segment.

Further according to the invention, the spacer stem may have a portion externally of the ball to which it is connected and the mass of the said portion of the spacer stem including the mass of the tail may be less than 100% of the mass of the ball. Preferably, the mass of the said portion of the spacer stem and including the mass of the tail is less than 50% of the mass of the ball.

The streamers forming the tail of the streamer ball of the invention particularly are configured and formed of a material that provides for the streamers to oscillate rapidly during flight and thereby generate a fluttering noise which, it is considered, will constitute a pleasing effect when playing a game with the streamer ball.

The combination of parameters in relation to the ball, the tail and the spacer stem of the streamer ball of the invention as are hereinabove defined, is such that when the ball of the streamer ball is struck with a bat during play of a game, with the tail following the ball, the configuration of the tail following the ball is re-established within a distance of approximately 1, 5 m from the location where the ball has been struck. It is thereby ensured that during play of a game only the ball will be struck with the bat used. The use of the elongate spacer stem particularly provides for the tail of the streamer ball to follow a path that ensures the above required flight characteristics of the streamer ball, the tail thus not becoming tangled with the ball and not being damaged when the ball is struck.

The parameters referred to above also are selected to provide for a flight loss of at least 30% when compared with the flight length of an equivalent ball without a tail. Also, the preferred flight length of the streamer ball in conjunction with a bat striking the ball is kept below approximately 30 m, through the air, the play of a ball and bat-type game as herein envisaged thereby being accommodated.

The streamer ball of the invention is described hereafter, by way of examples, with reference to the accompanying diagrammatic drawings. In the drawings:

DETAILED DESCRIPTION

Figure 1:
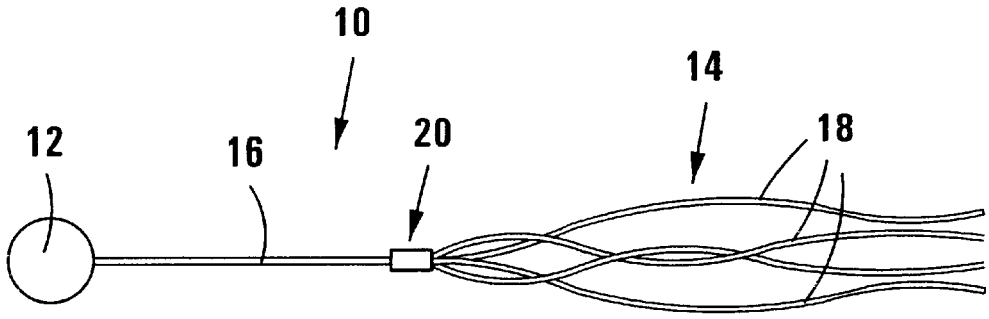
FIG. 1 shows a schematic side view of a streamer ball for use in a ball and bat-type game, in accordance with the invention.

Referring initially to FIG. 1 of the drawings, a streamer ball for use in a ball and bat-type game, in accordance with the invention, is designated generally by the reference numeral 10. The streamer ball 10 includes generally a ball 12, a tail 14 and a spacer stem 16, the spacer stem 16 having the tail attached thereto near one end thereof and having its other end connected to the ball 12.

Figure 2:
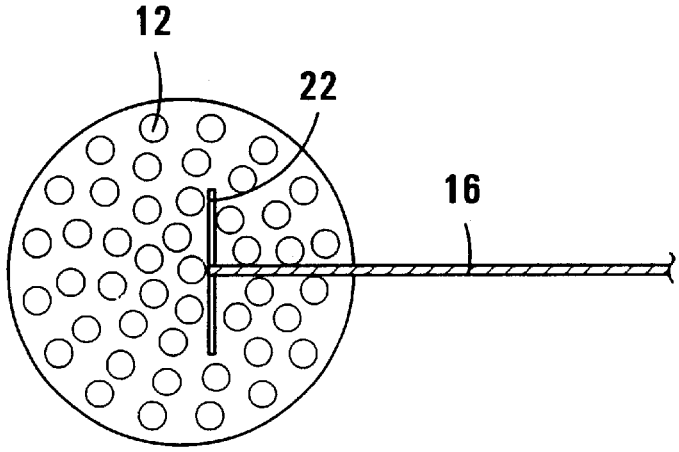
FIG. 2 shows a cross-sectional view of a first embodiment of a ball for a streamer ball as shown in FIG. 1.
Figure 3:
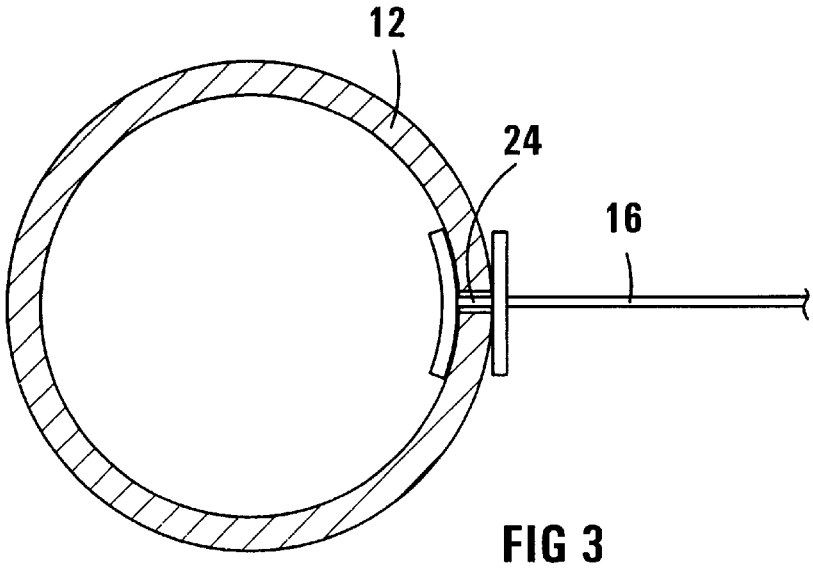
FIG. 3 shows a cross-sectional view of a second embodiment of a ball for a streamer ball as shown in FIG. 1.

The ball 12 is either one of a solid foam-type ball (as shown in FIG. 2) and a hollow tennis-type ball (as shown in FIG. 3), the ball typically having a diameter between 20 mm and 100 mm, a mass between 2 g and 75 g, a relative density no greater than approximately 0.75 and an air penetration factor no greater than 1.

The tail 14 comprises a plurality of thin, flexible streamer elements 18 that are formed of a synthetic plastics material having a thickness less than 0.06 mm, the streamer elements 18 having a flexibility rating between 20 mm and 100 mm. The length of the streamer elements must not be less than approximately two times the diameter of the ball of the streamer ball with which they are used, although this length otherwise may be greatly variable. The streamer elements 18 particularly are formed of a material that will oscillate rapidly during flight and thereby generate a fluttering noise during flight, after having been struck with a bat during play of a game using the streamer ball 10.

The spacer stem 16 of the streamer ball 10 also is formed of a resiliently flexible synthetic plastics material, preferably having a flexibility rating between 300 mm and 400 mm. The streamer elements 18 are attached to the spacer stem 16 in any suitable manner at a streamer attachment location 20 at one end of the stem 16, the opposite end of the stem 16 defining an anchor formation (as described in more detail hereinafter with reference to FIGS. 2 and 3 of the drawings) whereby this end of the spacer stem 16 is connected with the ball 12.

The spacing provided by the spacer stem 16 between the ball 12 and the spacer attachment location 20 is at least 25 mm. Also, the mass of the spacer stem 16, including that of the streamer elements 18 but excluding the anchor formation, preferably is not greater than 50% of the mass of the ball. The said segment between the ball and the tail should have a mass less than 3 g.

Referring particularly to FIG. 2 of the drawings, the ball 12 illustrated therein is a foam-type ball and the anchor formation 22 whereby the stem 16 is connected to the ball comprises a disc-like formation located in the configuration as shown. A T-piece formation also may serve as an anchor formation.

In FIG. 3 of the drawings, the ball 12 is a tennis-type ball and the anchor formation 24 of the stem 16 whereby the stem is connected to the ball, defines the configuration shown, whereby the wall of the ball is effectively engaged. Where the stem 16 projects through the wall of the ball, a snug fit is provided for that can limit the rate of release of air from the ball 12 upon being struck with a bat, the bounce qualities of the ball 12 hence not being unduly affected.

The overall configuration of the streamer ball of the invention may be greatly variable in order to accommodate different game requirements. It will be appreciated in this regard also that the mechanical configuration of the streamer ball is greatly variable, particularly also in relation to the mode of connection of the spacer stem of the streamer ball to the ball thereof.

A variation of the stem of the streamer ball, that is envisaged, provides for the flexibility rating of the stem along the length thereof to vary. For example, it may be advantageous for the stem to be less flexible in the region thereof where it extends from the ball, particularly in order to keep the streamer elements away from the ball during play of a game. The same can be accomplished by rendering a segment of the stem less flexible, typically by applying a tubular element over the segment of the stem where less flexibility is required. Although not specifically illustrated in the drawings, the above will be clearly apparent from the drawings.

Within the parameters herein defined and described, balls having various different characteristics can be provided for, it being generally envisaged that the maximum flight range of a streamer ball through the air should be in the order of 30 m with the flight length loss induced by the tail of the ball being in the order of 30%, compared with the flight length of an equivalent ball without a tail when similarly struck with the same bat.

The streamer ball of the invention can be rendered particularly suitable for use in conjunction with tennis-type games in respect of which the spacer stem of the streamer ball will have a relatively low flexibility rating when compared with streamer balls provided particularly for badminton and other volley-type games where the ball is not required to have any special bounce characteristics.

Figure 4:
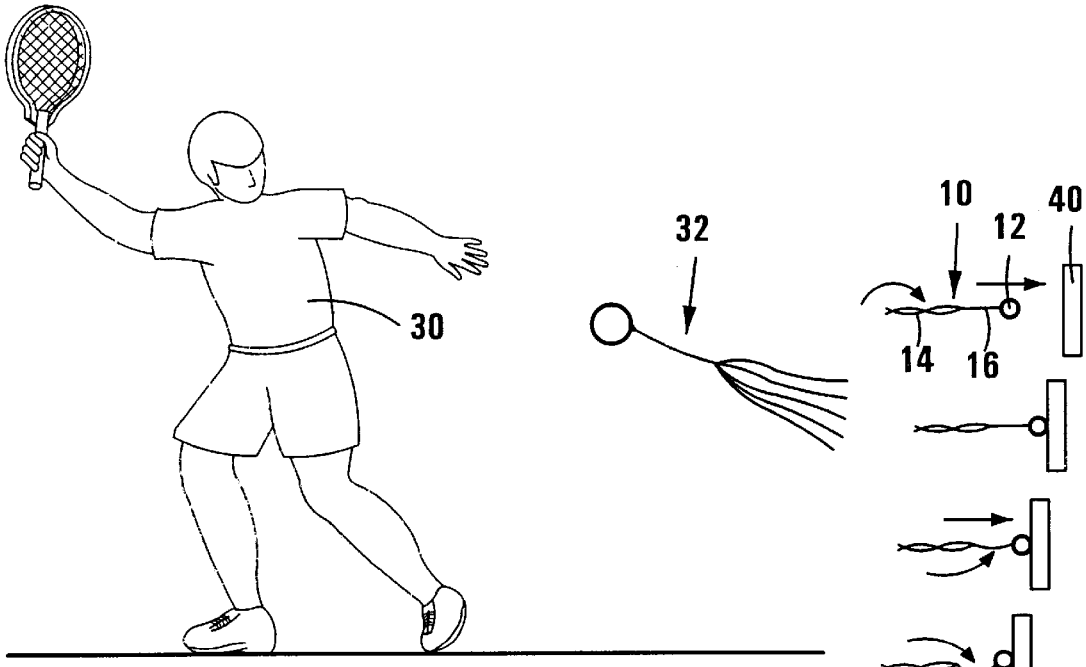
FIG. 4 illustrates the flight configuration of the streamer ball as shown in FIG. 1, with respect to a player playing a tennis-type game.

FIG. 4 illustrates a player 30, playing a tennis-type game and while preparing to strike a streamer ball 32, in accordance with the invention, the ball 32 being illustrated in its typical flight configuration after having been struck by an opposing player and after having bounced on the court side of the player 30.

With the tail separated from the ball by a spacer stem as described, the streamer elements forming the tail cannot easily become tangled with the ball, the flight path of the tail being determined by the characteristics of the spacer stem which separates the tail from the ball and which can be varied in accordance with particular game requirements.

Figure 5:
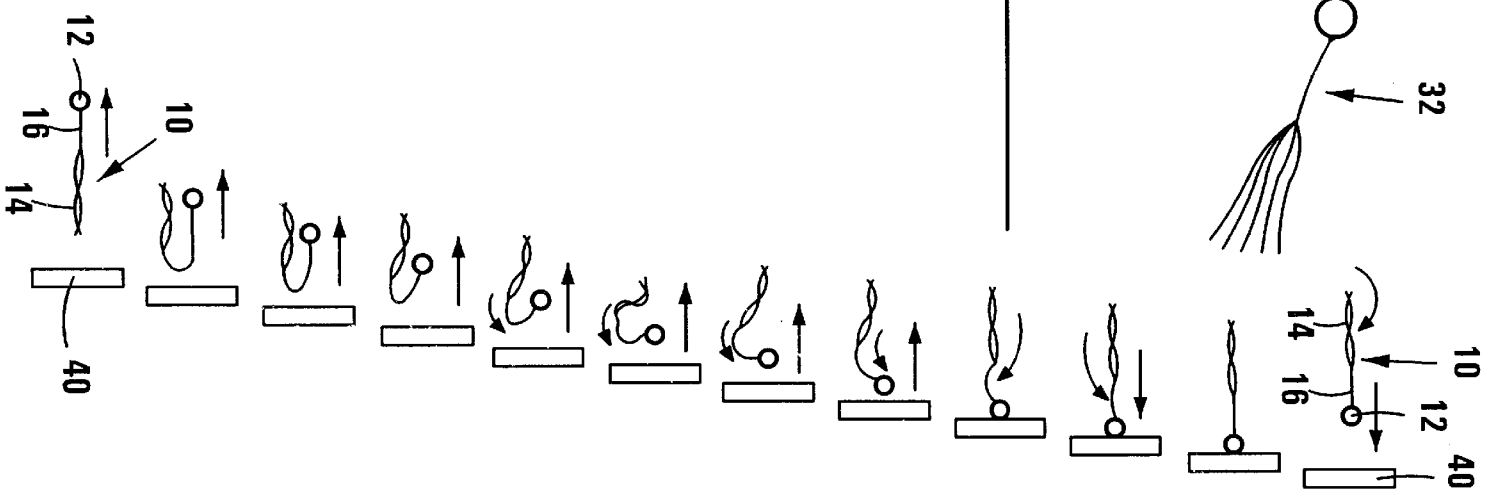
FIG. 5 illustrates a sequence of events associated with the streamer ball as shown in FIG. 1, being struck with a bat.

FIG. 5 particularly illustrates an approximation of a sequence of events associated with a streamer ball 10, in accordance with the invention, being struck with a bat 40. As is clear from these illustrations, upon being struck, the ball 12 is stopped by the bat 40, while the stem 16 initially flexes and then causes the ball to rotate through 180°, as it initiates its flight away from the bat 40. This results in the stem to "swing around" the ball with the tail 14 trailing the free end of the stem. The tail 14 thus remains outside the flight path of the ball 12, thus not becoming tangled with the ball at all and thus not being exposed to being damaged. When striking a streamer ball without a stem, the change of flight direction of the ball in fact causes the tail thereof to crumple and to tangle with the ball, crumpling causing damage to the tail while tangling of the tail with the ball causes the bat to impact on the tail also, causing still further damage. If untangling of the tail does not occur before the ball is struck again, the tail will be damaged still further when the ball is struck again, a streamer ball without a stem thus having a very limited life, particularly when compared with that of a streamer ball having a stem.

What is claimed is:

1. A streamer ball for use in a ball and bat-type game, which comprises a ball having a diameter between 20 mm and 100 mm, a mass between 2 g and 75 g, a relative density no greater than approximately 0,75 and an air penetration factor no greater than 1;

a tail comprising at least one thin, flexible streamer that has a flexibility rating between 20 mm and 100 mm, a length not less than approximately two times the diameter of the ball and a thickness less than 0,2 mm; and a resiliently flexible, elongate spacer stem having the tail attached thereto near one end thereof and having its other end connected to the ball, the spacer stem separating the attachment point of the tail from the ball by at least 25 mm and having a flexibility rating between 150 mm and 800 mm and a mass, between the tail and the ball, less than 3 g.

2. A streamer ball as claimed in claim 1, in which the ball is one of a hollow tennis-type ball and a solid foam-type ball.

3. A streamer ball as claimed in claim 1, in which the tail comprises a plurality of streamers, each streamer comprising an elongate flat flexible element of a synthetic plastics material and having a thickness less than 0,06 mm.

4. A streamer ball as claimed in claim 3, in which the maximum length of the streamers is in the order of 1000 mm.

5. A streamer ball as claimed in claim 1, in which the spacer stem comprises an elongate synthetic plastics element having an anchor formation defined at one end thereof which is formed to provide for connection of the spacer stem to the ball.

6. A streamer ball as claimed in claim 5, in which the anchor formation of the spacer stem is formed to provide for connection to a hollow tennis-type ball and in which the stem, when connected to the ball passes through an aperture in the wall of the ball.

7. A streamer ball as claimed in claim 6, in which the stem provides a snug fit within the aperture in the wall of the ball which inhibits the rate of release of air from the ball for retaining the bounce qualities of the ball.

8. A streamer ball as claimed in claim 1, in which the spacer stem has a flexibility rating between 300 mm and 400 mm.

9. A streamer ball as claimed in claim 1, in which the spacer stem has a flexibility rating that varies along the length thereof.

10. A streamer ball as claimed in claim 1, in which the spacer stem has a tubular element located over a segment that renders the stem less flexible in the region of the said segment.

11. A streamer ball as claimed in claim 1, wherein the connection of the spacer stem to the ball provides for an end portion of the spacer stem to extend into the ball and the remainder of the spacer stem to extend from the ball and wherein the mass of the said remainder of the spacer stem including the mass of the tail is less than 100% of the mass of the ball.

12. A streamer ball as claimed in claim 11, wherein the mass of the said remainder of the spacer stem and including the mass of the tail is less than 50% of the mass of the ball.

* * * * *